US007427063B2

(12) United States Patent
Fairweather et al.

(10) Patent No.: US 7,427,063 B2
(45) Date of Patent: Sep. 23, 2008

(54) SHINGLE MEDIA ITEM FEED TRAY WITH SPRING LOADED SELF LOCKING SLED

(75) Inventors: James A. Fairweather, Milford, CT (US); Donald Surprise, Waterbury, CT (US); James A. Salomon, Cheshire, CT (US); Norman R. Lilly, Monroe, CT (US); Thomas M. Lyga, Southbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 254 days.

(21) Appl. No.: 11/266,878

(22) Filed: Nov. 4, 2005

(65) Prior Publication Data

US 2007/0102869 A1 May 10, 2007

(51) Int. Cl.
*B65H 1/02* (2006.01)

(52) U.S. Cl. ..... 271/149; 271/160

(58) Field of Classification Search ..... 271/147, 271/148, 149, 160; 221/226, 279; 211/59.3
See application file for complete search history.

(56) References Cited

U.S. PATENT DOCUMENTS 1,152,358 A * 8/1915 Reifsnyder et al. ..... 271/149
1,783,912 A * 12/1930 Van Der Pyl et al. ..... 271/149
3,780,873 A * 12/1973 Silva ..... 211/59.3
4,280,692 A * 7/1981 Hutchinson et al. ..... 271/160
4,662,623 A * 5/1987 Nakanishi ..... 271/150
5,100,022 A * 3/1992 Fukudome et al. ..... 221/198
5,167,408 A * 12/1992 Golicz ..... 271/149
5,199,695 A * 4/1993 Nakahata et al. ..... 271/9.12
5,284,335 A * 2/1994 Golicz ..... 271/149
5,292,116 A * 3/1994 Inoue et al. ..... 271/157
5,335,899 A * 8/1994 Golicz ..... 271/34
5,398,931 A * 3/1995 Tohgoh ..... 271/126

(Continued)

FOREIGN PATENT DOCUMENTS

EP 1 462 401 A 9/2004

(Continued)

*Primary Examiner*—Patrick Mackey
*Assistant Examiner*—Michael C McCullough
(74) *Attorney, Agent, or Firm*—Steven J. Shapiro; Angelo N. Chaclas

(57) ABSTRACT

A media item feed tray with an exit area for media items includes a sled moveable toward and away from the feed tray exit area. A biasing surface is mounted to the tray and extends away from the feed tray exit area. A spring member is mounted on the moveable sled and is connected to the biasing surface such that when the moveable sled is moved away from the feed tray exit area energy is stored in the spring member. The biasing surface may be a shaped rail with a cam surface and the moveable member may include a cam follower which engages the shaped rail cam surface. A first cam section and a second cam section can be provided with the moveable sled urged toward the feed tray exit area when the cam follower engages the shaped rail first cam surface section and urged away from the feed tray exit area when the cam follower engages the shaped rail second cam surface section. A mechanism can be provided for locking the sled from movement and with a sled front face which can be positioned to facilitate loading of media items into the feed tray and positioned for media item feeding operation.

8 Claims, 11 Drawing Sheets

U.S. PATENT DOCUMENTS

| | | | | |
|---|---|---|---|---|
| 5,451,037 | A | 9/1995 | Lundstrom | |
| 5,476,254 | A * | 12/1995 | Golicz | 271/10.05 |
| 6,279,719 | B1 * | 8/2001 | Israel | 194/248 |
| 6,502,816 | B2 * | 1/2003 | Inoue et al. | 271/121 |
| 6,592,118 | B2 * | 7/2003 | Youn | 271/147 |
| 6,869,072 | B2 * | 3/2005 | Andersson | 271/149 |
| 6,896,255 | B1 * | 5/2005 | Fick et al. | 271/126 |
| 2003/0173732 | A1 * | 9/2003 | Andersson | 271/149 |
| 2006/0220298 | A1 * | 10/2006 | Fairweather et al. | 271/10.09 |
| 2006/0226594 | A1 * | 10/2006 | McAlpine et al. | 271/149 |
| 2007/0102865 | A1 * | 5/2007 | Surprise et al. | 271/10.01 |

FOREIGN PATENT DOCUMENTS

| | | | |
|---|---|---|---|
| JP | 57 180537 | A | 11/1982 |
| JP | 60 153339 | A | 8/1985 |
| JP | 04066421 | A * | 3/1992 |

* cited by examiner

SHINGLE MEDIA ITEM FEED TRAY WITH SPRING LOADED SELF LOCKING SLED

RELATED APPLICATIONS

This U.S. patent application Ser. No. 11/266,878, for SHINGLE MEDIA ITEM FEED TRAY WITH SPRING LOADED SELF LOCKING SLED, filed Nov. 4, 2005, in the names of James A. Fairweather, Donald Surprise, James A. Salomon, Norman R. Lilly and Thomas M. Lyga includes: partial common; inventorship, drawings, and detailed description; and common: filing date and assignee with: U.S. patent application Ser. No. 11/267,389, for SHINGLE MODE MEDIA ITEM FEED ARRANGEMENT, filed Nov. 4, 2005, in the names of Theresa Bartick, Donald Surprise, Norman R. Lilly, James A. Fairweather; and U.S. patent application Ser. No. 11/267,003, for MULTIMODE STACK AND SHINGLE DOCUMENT FEEDER, filed Nov. 4, 2005, in the names of James A. Fairweather, Thomas M. Lyga and Theresa Bartick.

FIELD OF THE INVENTION

The present invention relates to a media item shingle feed tray for systems, such as paper handling systems including printers, folders or inserter, and more particularly to a shingle media feed tray with a spring loaded sled.

BACKGROUND OF THE INVENTION

For certain types of media items, such as envelopes, in order to load a volume of media items into a feed tray, the material is shingled. In this mode, the media items are stacked on edge in a feed tray and fed from the tray into the feeder. Control of stack force in shingle mode feeding is critical to the successful function of the feeder.

To provide stack forces on the shingled media item, the angle of the feed tray with respect to a feeder has been varied, as has the weight of a moveable sled provided to urge the shingled media items toward the feeder. The weight of the shingle feed tray sled, which may be adjusted by the sled design and the inclusion of dead weights, can create a slide hammer effect. This is a situation where the sled, for example, during handling of a feed tray when loading media items into the tray or connecting the tray to a feeder, can quickly slide from one end of the shingle feed tray to the other, striking the sled stops.

Feeders have utilized shingle feed trays mounted to the feeder with various tray angles such as between 22 and 25 degrees, to facilitate movement of the media items from the feed tray into the feeder. Arrangements of this type are employed in Pitney Bowes Inc. of Stamford, Conn., inserter products, such as the Pitney Bowes DI350, DI400, DI500, DI600, DI800 and console inserter systems. At such angles, most shingled media items readily slide down the feed tray guided by the side guides of the tray. However, the stack force against the feeder nudger separator system to singulate shingled media items from the stack of media items in the feed tray becomes a strong function of the amount of shingled media items in the feed tray.

The reliable performance of the feeder in singulating the shingled media items becomes impacted by the amount of shingled media items in the feed tray pressing against the current media item to be singulated. Treatments have been added to the surface of the side guides of shingle feed trays to regulate the friction between the shingled media items and the side guides. These treatments are implemented in efforts to increase reliable movement of the shingled media item stack toward the exit area of the feed tray and the feeding and singulation of the media item at the feed tray exit area. Side Guide treatments have included tapes, Teflon paints, oils, and plastic shims. Side Guide treatments of this type have been employed in products such as the Pitney Bowes DI350, DI400, DI500, DI600, DI800 and console inserter systems.

SUMMARY OF THE INVENTION

It is an object of the present invention to provide an improved shingle feed tray for media items.

It is another object of the present invention to provide a shingle feed tray arrangement which reduces the effect of varying stack forces on shingled media items as a function of the amount of shingled media items in a feed tray.

It is yet another object of the present invention to provide a shingle feed tray sled where the sled can not quickly slide from one end of the feed tray to the other which would result in a slide hammer effect.

It is yet further object of the invention to provide a shingle feed tray which facilitates the loading of media items into the feed tray.

It has been discovered that a shingled media item stack can be urged to advance down a feed tray toward a feed tray exit area by a spring driven sled where the sled force is developed by loading a member against a biasing surface, such as a shaped rail, which for example may be a tapered rail. A force component of the member against the biasing surface is in a direction for movement of the sled. The shaping of the biasing surface may be such to achieve a variation in the force, as desired, over the course of the movement of the sled toward the tray exit area. The sled weight can be employed, with or without a dead weight, to help with movement of the sled to urge shingled media items to move toward the feed tray exit area. With the present arrangement, a slide hammer effect due to the weight of the sled is avoided.

It has been further discovered that the tapered rail can employ a reverse taper at the location, such as where the sled is fully retracted, reversing the direction of the driving force on the sled. The retracted position moves the sled to a position where the feed tray can be loaded with shingled media items. To further facilitate loading of media items into the tray, the front face of the sled, such as the sled handle, can be made moveable to a position adjacent to the feed tray bottom surface. The movement of the sled front face adjacent to the feed tray bottom surface can lock the sled from movement to still further facilitate loading of shingled media items into the tray.

In accordance with the embodiment of the present invention, a media item feed tray having an exit area for media items, includes a sled moveable toward and away from the feed tray exit area. A biasing surface is mounted to the tray extending away from the feed tray exit area. A spring member is mounted on the moveable sled and is connected to the biasing surface such that when the moveable sled is moved away from the feed tray exit area, energy is stored in the spring member.

In accordance with a feature of the present invention, the biasing surface is a shaped rail which includes a cam surface. The moveable member includes a cam follower engaging the shaped rail cam surface. The shaped rail may include a first shaped section and a second shaped section. The moveable sled is urged toward the feed tray exit area when the cam follower engages the shaped rail first cam surface section. The moveable sled is urged away from the feed tray exit area when the cam follower engages the shaped rail second cam surface section.

In accordance with a feature of the present invention, a media item feed tray having an exit end for media items includes a sled moveable toward and away from the feeder tray exit area. A locking mechanism is provided for locking the sled from movement toward and away from the exit area. The locking mechanism includes a moveable front face. The front face is moveable into a first position to lock the sled from movement and the front face is moveable into a second position where the sled is moveable toward and away from the feed tray exit area.

In a media item feed tray having an exit area for media items and a sled moveable toward and away from said feed exit area, a method for moving media items in said tray toward the exit area embodying the present invention includes moving the sled away from the exit area to store energy in a spring member. Loading a stack of media items into the feed tray and moving the sled toward the exit area to bear against the stack of media items. Urging the spring member against a biasing surface and employing the energy stored in the spring member against the biasing surface to urge the moveable sled and the stack of media items toward the feed tray exit area.

BRIEF DESCRIPTION OF THE DRAWINGS

Reference is now made the various figures wherein similar reference numerals designate similar items in the various views and in which.

DETAILED DESCRIPTION OF THE PREFERRED EMBODIMENT

Figure 1:
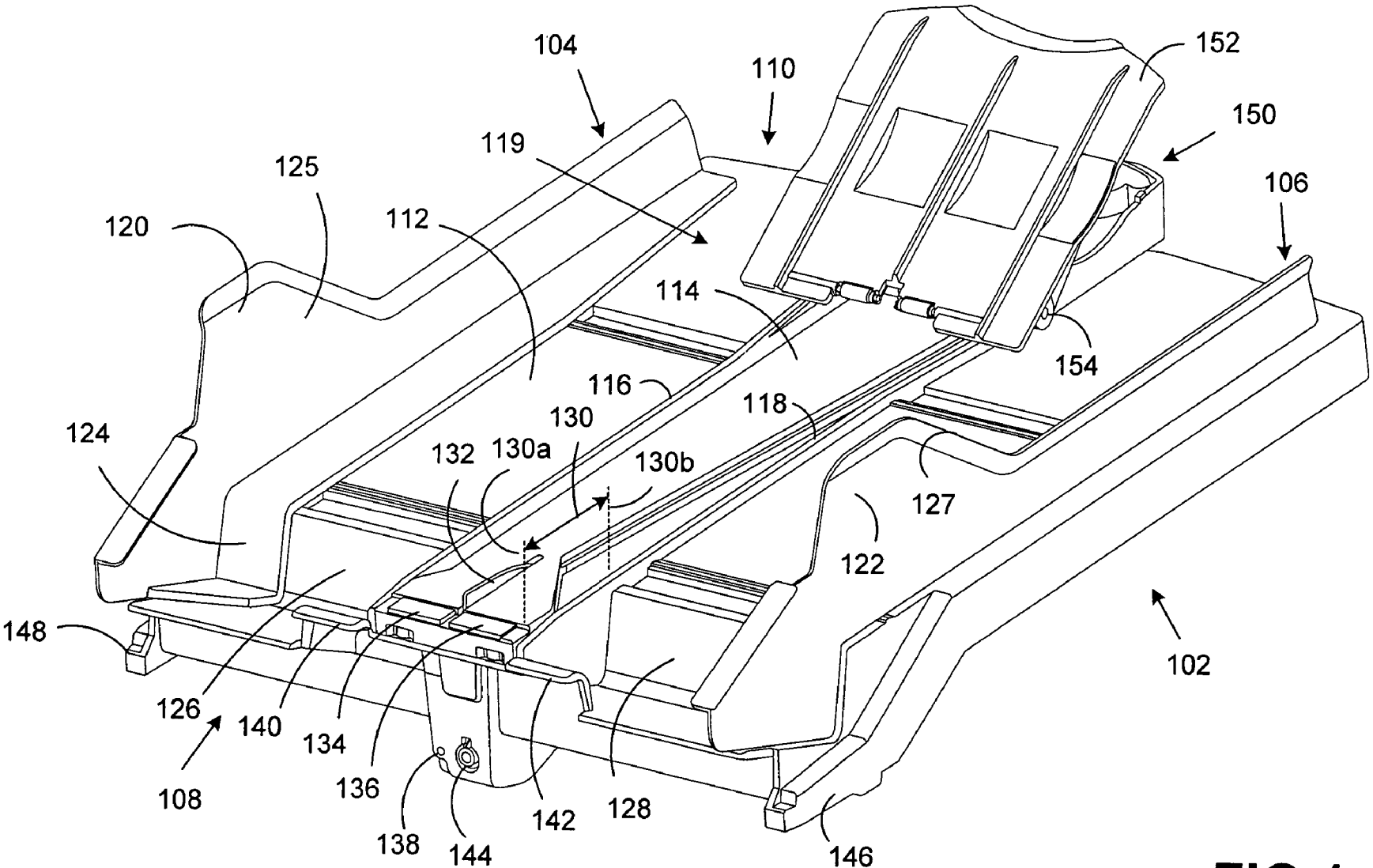
FIG. 1 is a perspective view of a shingle feed tray for media items embodying the present invention.
Figure 2:
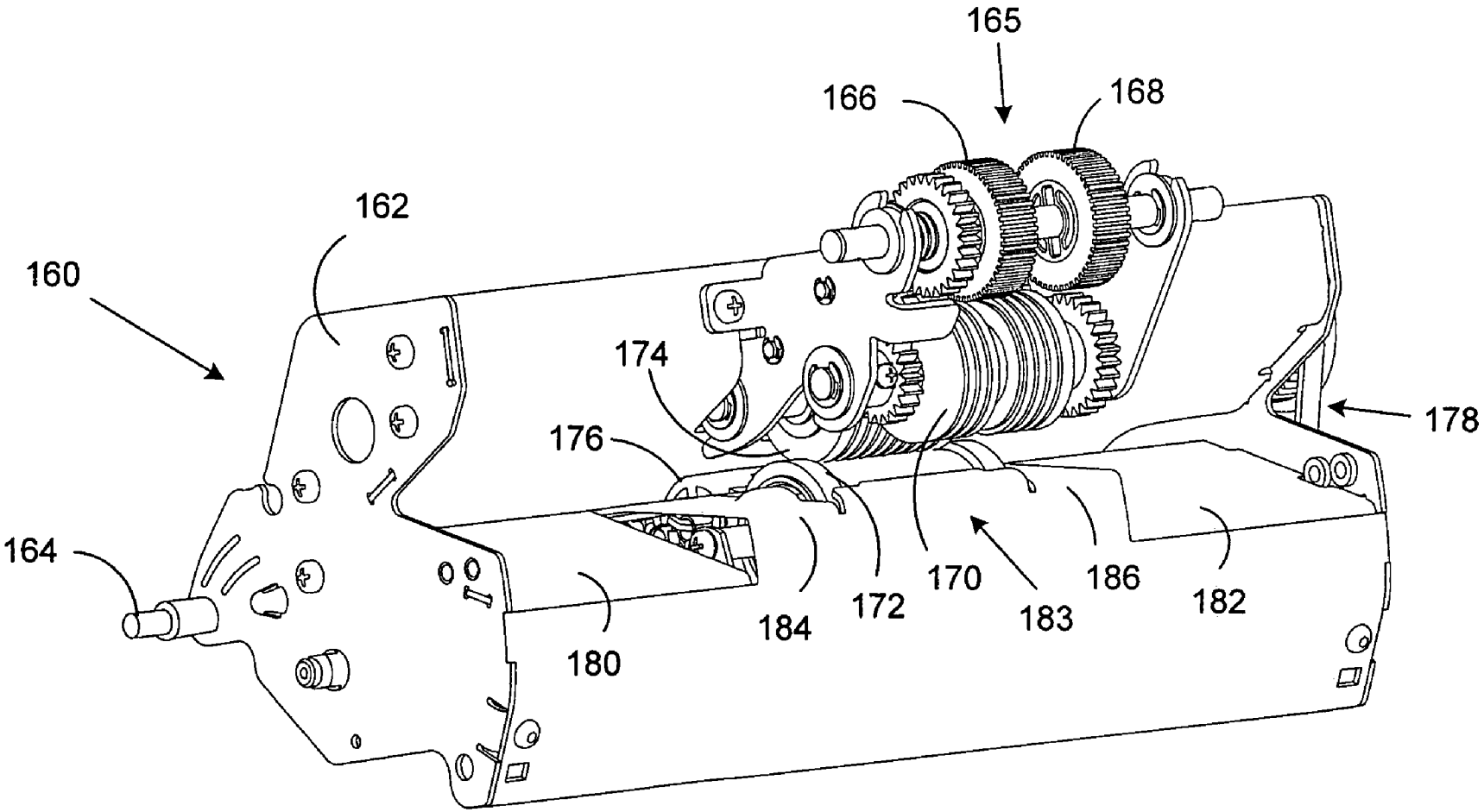
FIG. 2 is a perspective view of a portion of a feeder adapted to work in conjunction with the feed tray shown in FIG. 1 and embodying aspects of the present invention.
Figure 3:
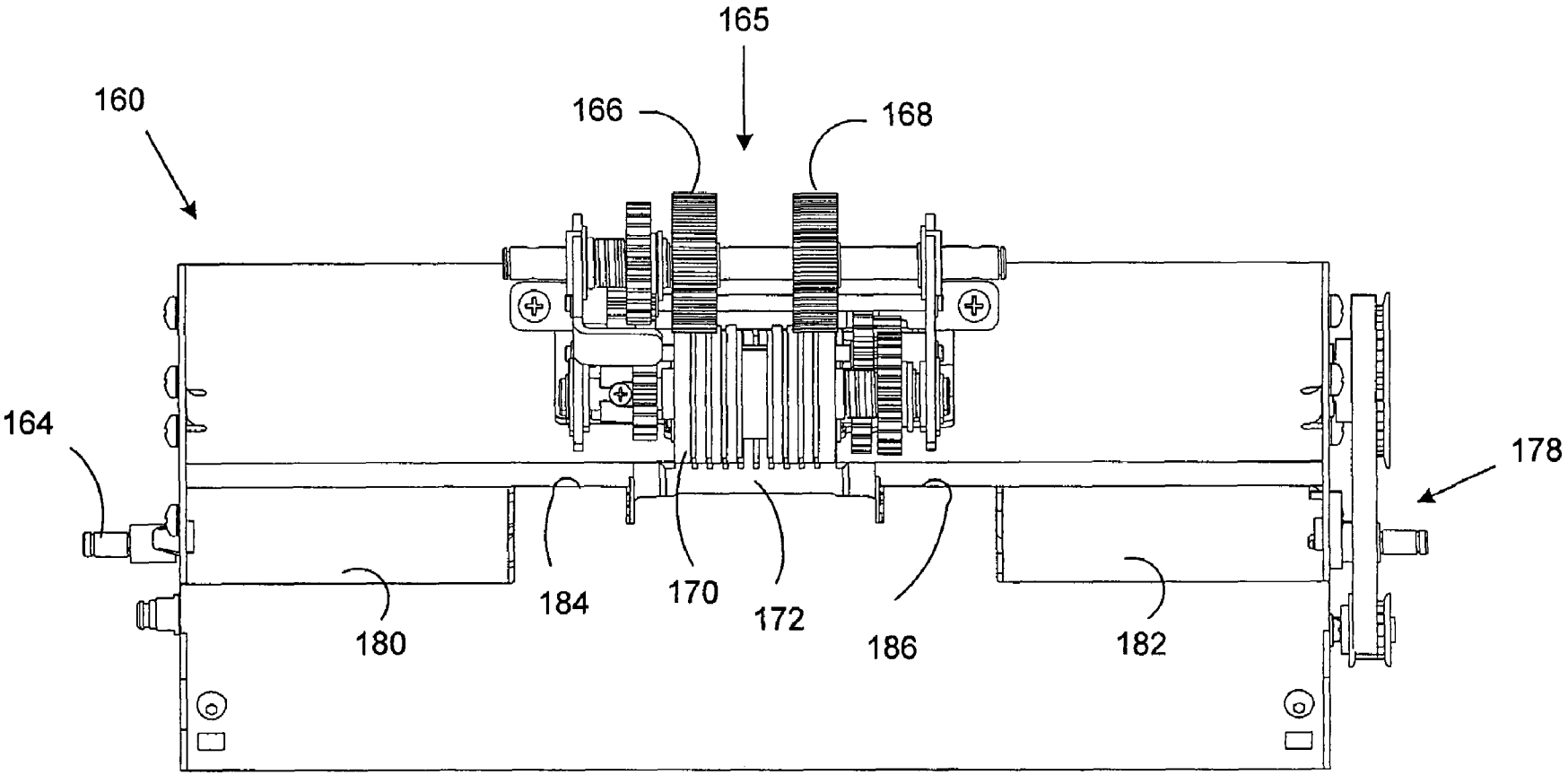
FIG. 3 is a front view of the feeder shown in FIG. 2.

Reference is now made to the various figures. A shingle media feed tray 102 includes moveable side guides 104 and 106 adapted to contact the edges of media items loaded into the tray. The side guides 104 and 106 help guide media items as they are moved toward the exit area 108 of the tray 102 from the tray rear area 110. The tray 102 includes a bottom surface 112 onto which are mounted a shaped rail such as tapered rail 114 and two support rails 116 and 118. The tapered rail 102 provides the biasing surface for the particular feed tray arrangement. Support rails 116 and 118 are provided to support the bottom edge of shingled media items when loaded into the shingle tray 102. The support rails 116 and 118 are higher than the tapered sled rail 114, rising above the upper surface of the tapered sled rail 114. The support rails 116 and 118 may have a 2.5 millimeter thickness, however, the thickness of the rails is not critical. The rails are designed to support the media bottom edge and provide centralized drag force to the material, thus avoiding outboard forces which may impart moments on the material which, if imbalanced, could induce skew.

The side guides 104 and 106 may be moved in and out of engagement with the sides of media items loaded into the shingle tray receptacle area 119 for a plurality of media items. The side guides 104 and 106 may be operated by any conventional mechanism or in the manner shown in U.S. patent application Ser. No. 11/123,617 filed on May 6, 2005 by James A. Solomon, Donald Surprise and Christopher D. Clarke entitled DETACHABLE FEED TRAY WITH SELF-ADJUSTING SIDE GUIDES and assigned to Pitney Bowes Inc.

The side guides 104 and 106 each engage the side edges of the media items along the entire length of each side guides. The area of the side guides 120 and 122 toward the exit area 102 are of a greater height than other the portions of the side guides 104 and 106. This is to provide greater lateral guidance of the media item edges adjacent the exit area 108. The lower portions of the side guides 104 and 106 facilitate loading of media items into the tray. Side guide 106 is the mirror image of side guide 104, with section 122 as the mirror image of section 120

If desired for any particular application, the side guides 104 and 106 each may be dimensioned, in an alternate arrangement not shown, to have a section toward the exit area 108 of the tray which does not engage the side edges of media items. In such alternative arrangement, the sections of the side guide 120 and 122 would be modified and configured to be out of engagement with media item side edges adjacent the exit area 108.

The side guides 104 and 106 as shown in the various figures include a section 124 shown on side guide 104 and a section 125 on side guide 106 that drop away from and are below the surface of rails 116 and 118 and surface 112 of the tray. This forms two cavity areas shown generally at 126 and 128, toward the front area 108 of the tray 102. In this area of the tray 102, media items moving toward the exit area 108 of the shingle tray are supported on the bottom edge solely on the support rails 116 and 118. Accordingly, in this area, media items such as envelopes, which have four edges are supported in the tray on their bottom edge solely by the support rails 116 and 118. The area of the tray where the bottom edge the media items is supported by and engaged by the two support rails 116 and 118 is denoted by the line 130 with two arrow heads. The side edges the media items are guided by the tray 102 by side guides 104 and 106. Additional support for the media items are from adjacent media items with the last media item to exit the tray 102 having additional support from sled 150.

Line 130 denotes the length of the support rails 116 and 118 between the front of the support rails (arrow head 130*a*) and the surface 125 of side guide 104 (arrow head 130*b*). Arrow heads 130*a* and 130*b* touch the dashed lines, signifying, respectively, the front of the rails 116 and 118 and surface 125. The corresponding surface for guide 106 is surface 127. The media items thus exit the tray 102 supported by rails 116 and 118 as they pass through the cavity areas 126 and 128 into a feeder or other mechanism. The length of the support rails 116 and 118 denoted by line 130 is 60 millimeters. However, the length is a matter of design choice and involves tradeoffs between the specified capacity of the feeder, the maximum acceptable height of the tray above the working surface, and the overall specification of system. The length of the support rails 130 is also involves a compromise between the desire for structural integrity, and the need to create cavity areas 126 and 128 of sufficient size as to accommodate shingle material having imperfections such as curl, corner deformations, and irregular cross-sections that may result in uneven bending.

The tray 102 includes an out of media sensor 132 and two rubber pads 134 and 136 at the edge of the exit area 108 of the tray 102. The rubber pads 134 and 136 help with the singulation of media as the media is moved into the feeder. A magnet 138 is provided to cooperate with a mechanism in the feeder so that the feeder can sense the type of feed tray inserted into the feeder, here shingle-type feed tray 102. The shingle feed tray 102 includes two up-stop tabs 140 and 142, which cooperate with a feeder nudger roller mechanisms to properly position the feedhead assembly 160, and thus the nudger rollers 166 and 170, with respect to the media items in the feed tray. A second magnet 144 cooperates with the out of media items sensor 132 to provide information to the feeder regarding the status of the feed tray. Arms 146 and 148 are operable to engage with the feeder mechanism to position and lock the shingle tray 102 into proper position with respect to the feeder.

The shingle tray 102 includes a spring-driven sled 150 that is mounted to the tapered sled rail 114. The sled 150 includes a front face, such as a handle 152, which is collapsible to pivot around the pivot 154. The handle 152 (front face) can be operated to rotate down toward the bottom surface 112 of the tray 102. The positioning of the handle 152 adjacent to the tray surface 112 facilitates loading of media items into the tray receptacle area 119. Different volumes of shingled media items may be loaded into the tray receptacle area 119 and the sled 150 moved to engage the last media item loaded into receptacle area 119. The position of the handle 152 (front face) shown in FIGS. 1, 4, 5 and 6, is at an angle from the bottom surface 112 where the front face is positioned to support media items in shingled orientation in the tray 102.

A feeder 183 includes a feed head assembly 160 having a frame 162 which is adapted to rotate around a pivot 164. The frame 162 and thus feed head assembly 160 rotate around the pivot 164 into the appropriate position when a shingle or a stack feed tray is engaged with the feeder mechanism. The pivot 164 is connected to a frame 207 which provides the ground or base for the pivot 164 around which the feed head assembly 160 rotates. The feed head assembly 160 includes an upper nudger roller 165 having two nudger roller elements 166 and 168 and a lower nudger roller 170 having a series of ribbed surfaces. The two nudger roller elements 166 and 168 are positioned equidistant from the center line of the path of movement of media items from the shingle feed tray 102. Various types of nudger roller arrangements may be employed. For example, the upper nudger roller may be a single element nudger roller and the lower nudger roller can have three nudger roller elements. Selection of the height and width of each nudger assembly is done with the goals of minimizing skew, and controlling the attitude of the approaching shingled stack. The assembly 160 also includes a separator roller 172, which cooperates with a feed roller 174. A take-away roller 176 is also provided. The drive to the various rollers is provided by a belt drive system 178.

The feed head assembly 160 includes two recessed areas 180 and 182. When a shingle media tray is engaged with the feed head assembly 160, the media items are supported on rails 116 and 118, as shown in FIG. 1, until the media is moved into operative engagement with the separator roller 172 and the feed roller 174. In this manner, the media items being transitioned from the shingle tray 102 into the feed head assembly 160 are not caused to skew by any forces on the edges of the media items due to either friction with the portions of the shingle tray or friction with portions of the feed mechanism. Bending of the media item does not occur until the media item is fully captured between the separator roller 172 and feed roller 174.

Figure 4:
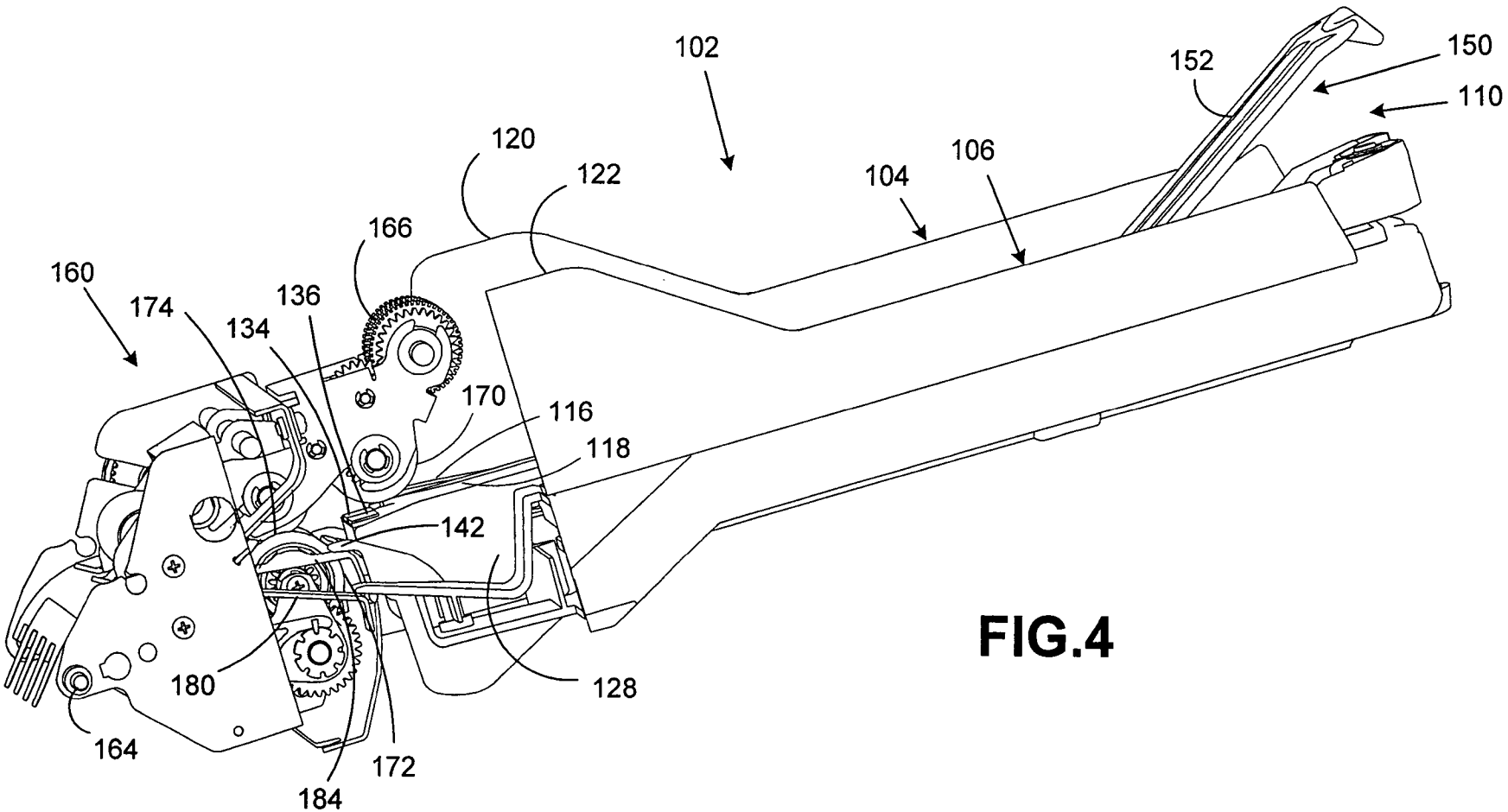
FIG. 4 is a cut away perspective side view of the shingle feed tray shown in FIG. 1 connected to the feeder shown in FIGS. 2 and 3 illustrating how the shingle feed tray engages and operates in conjunction with the feeder.

The front of the feeder 183 includes two up-stop feeder contact surfaces 184 and 186. These feeder contact surfaces cooperate with and are engaged with the two up-stop tabs 140 and 142 of the shingle feed tray 102. As is shown in FIG. 4, the tray 102 up-stop tab 142 engages the sheet metal portion 184 to lock and limit the upward or counterclockwise rotation of the feed head assembly 160 around the pivot 164 to a minimal rotation for feeding shingled media items. This minimal rotation is not related to the volume of shingled media items in shingle feed tray 102. The stops cooperate to position the nudger rollers 165 and 170 to be properly oriented so that both nudger rollers engage shingled media items exiting the feed tray 102 as they are moved on the support rail 118 and the support rail 116 (not shown in FIG. 4) into operative engagement with the separator roller 172 and the feed roller 174.

Figure 5:
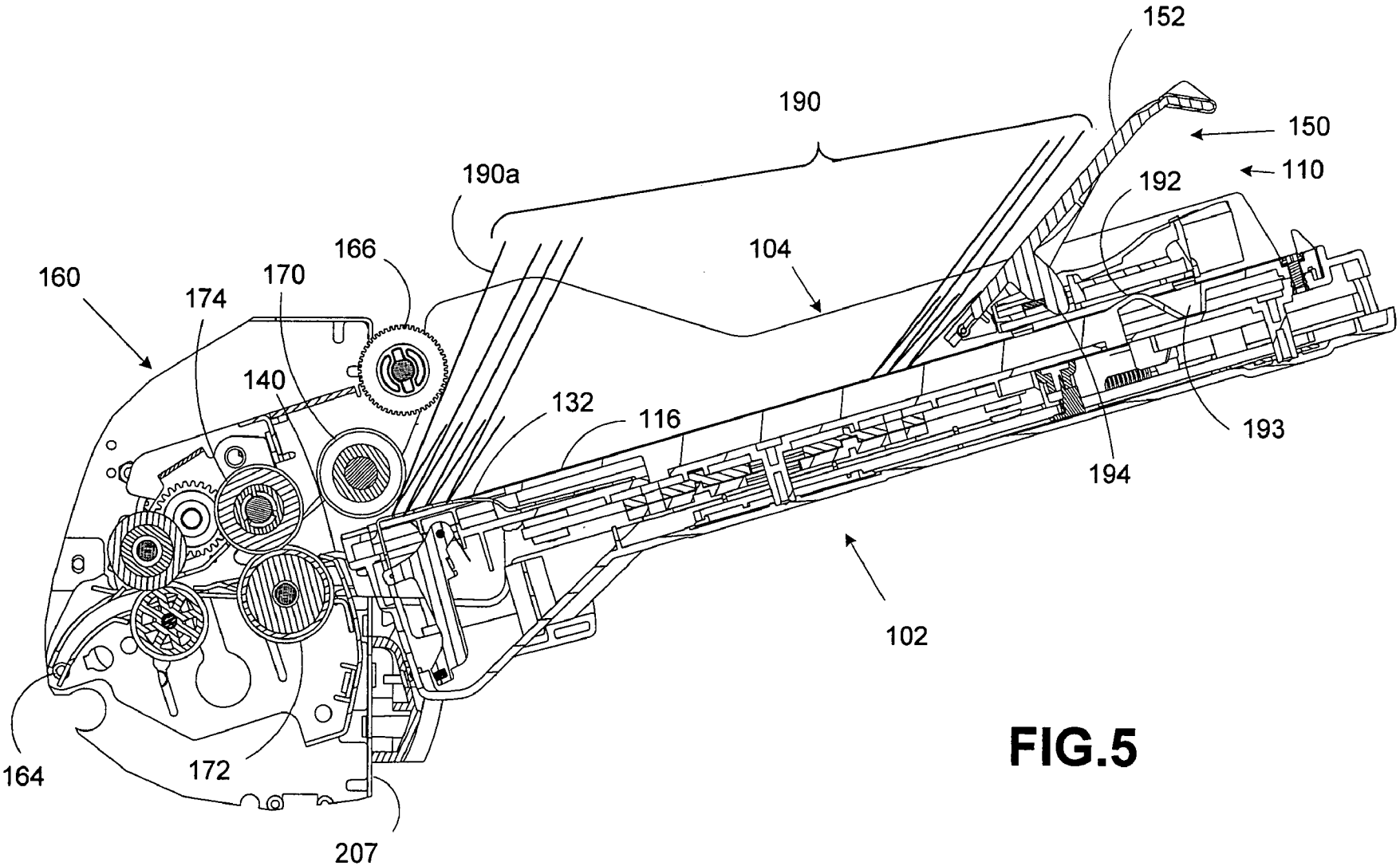
FIGS. 5 and FIG. 6 are side views of the mechanism shown in FIG. 4, with different volumes of shingled media in the shingle feed tray.
Figure 6:
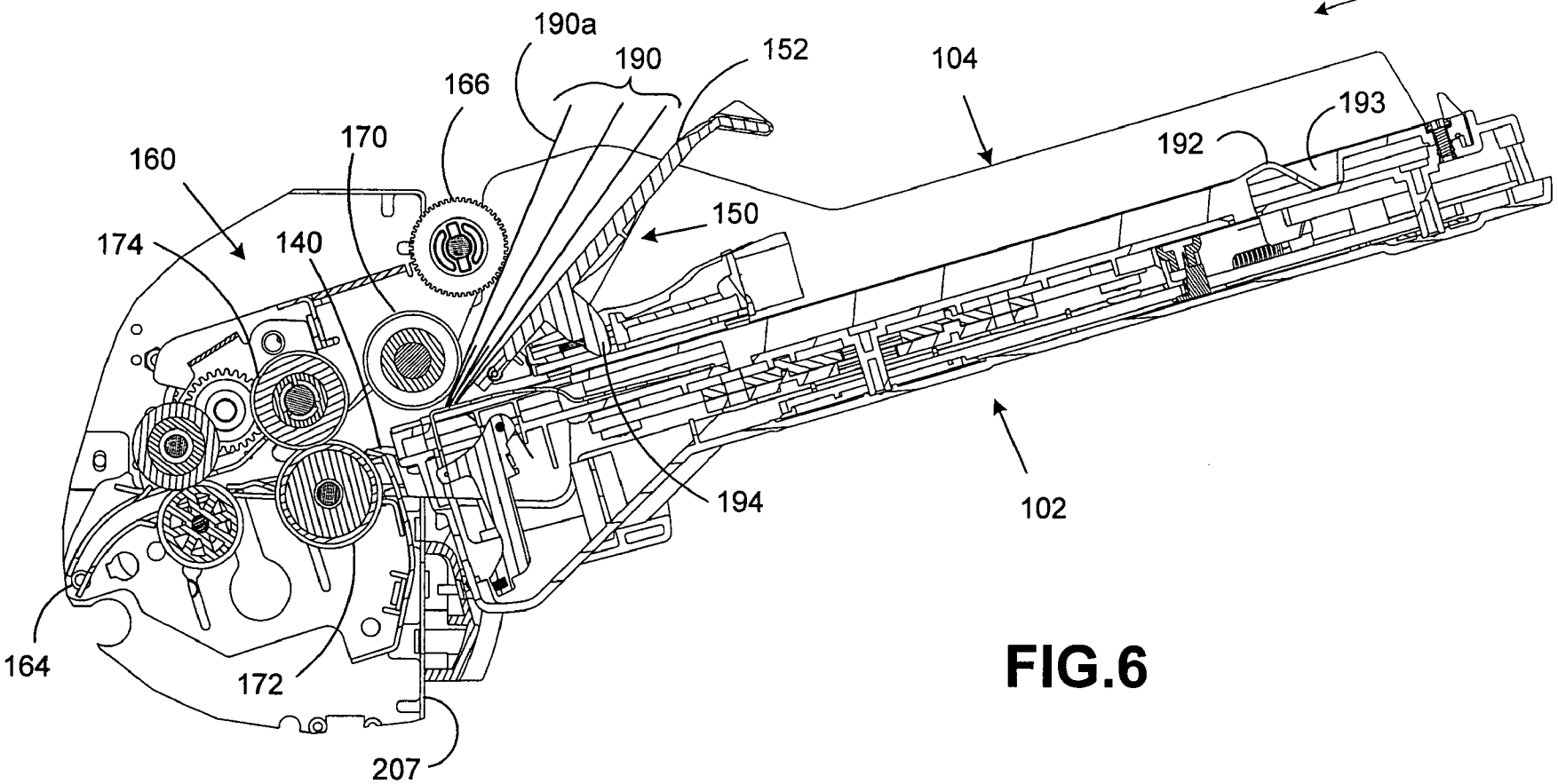

A shingled stack of media items shown as envelopes 190, as shown in FIGS. 5 and 6, are loaded into the shingle feed tray 102. The surface of the handle 152 engages the rearmost envelope in the shingled stack. The two nudger rollers 166 and 170 are shown engaging the envelope in the stack 190 closest to the exit point of the tray. The envelope 190*a* will be moved under the pressure of the spring loaded sled 150 and the operation of the nudger rollers 166 and 170 along the support rail 116 and support rail 118 (not shown in FIG. 5) into operative engagement with the separator roller 172 and the feed roller 174.

A cam surface 192 in the lower surface of the tray 102 cooperates with a cam follower locking projection 194 attached to the handle of 152 of the sled 150. The function of the cam 192 is to ensure that the handle is cammed to the position shown where it is positioned to support shingled media items as the sled is moved toward the front of the tray 102. Accordingly, after the media items are loaded into the tray 102 with the handle in the folded position, as the sled is moved toward the media exit end of the tray, the handle 152 is caused to rotate in a counterclockwise direction to be properly positioned to support the shingle media in the correct orientation for cooperation with the feed head assembly 160 and, more specifically, the feeder nudger rollers 165 and 170.

The stack of media items 190 is smaller, as shown in FIG. 6, than the stack of media items shown in FIG. 5. Accordingly, in FIG. 6, the sled 150 is located closer to the exit area of the shingle feed tray as compared to FIG. 5. The sled 150 and the energy stored in the sled spring (not shown in FIG. 6) has been employed to help move the media items into the feed head assembly 160.

It has been determined that a stack of shingled media items presented to a pivoting feed head at an angle of greater than approximately 15 degrees could hold a pivoting feed head up due to friction between the front of the media items and the pivoting guide surface of the feed head assembly shown in the various figures. It has also been determined that shingle stacks were approximately neutral at a 15 degree angle for the feed head assembly shown in the various figures, indicating that shingle mode stack force could potentially be regulated by providing a biasing load to the back of the shingle stack by means of a moveable sled.

Figure 7:
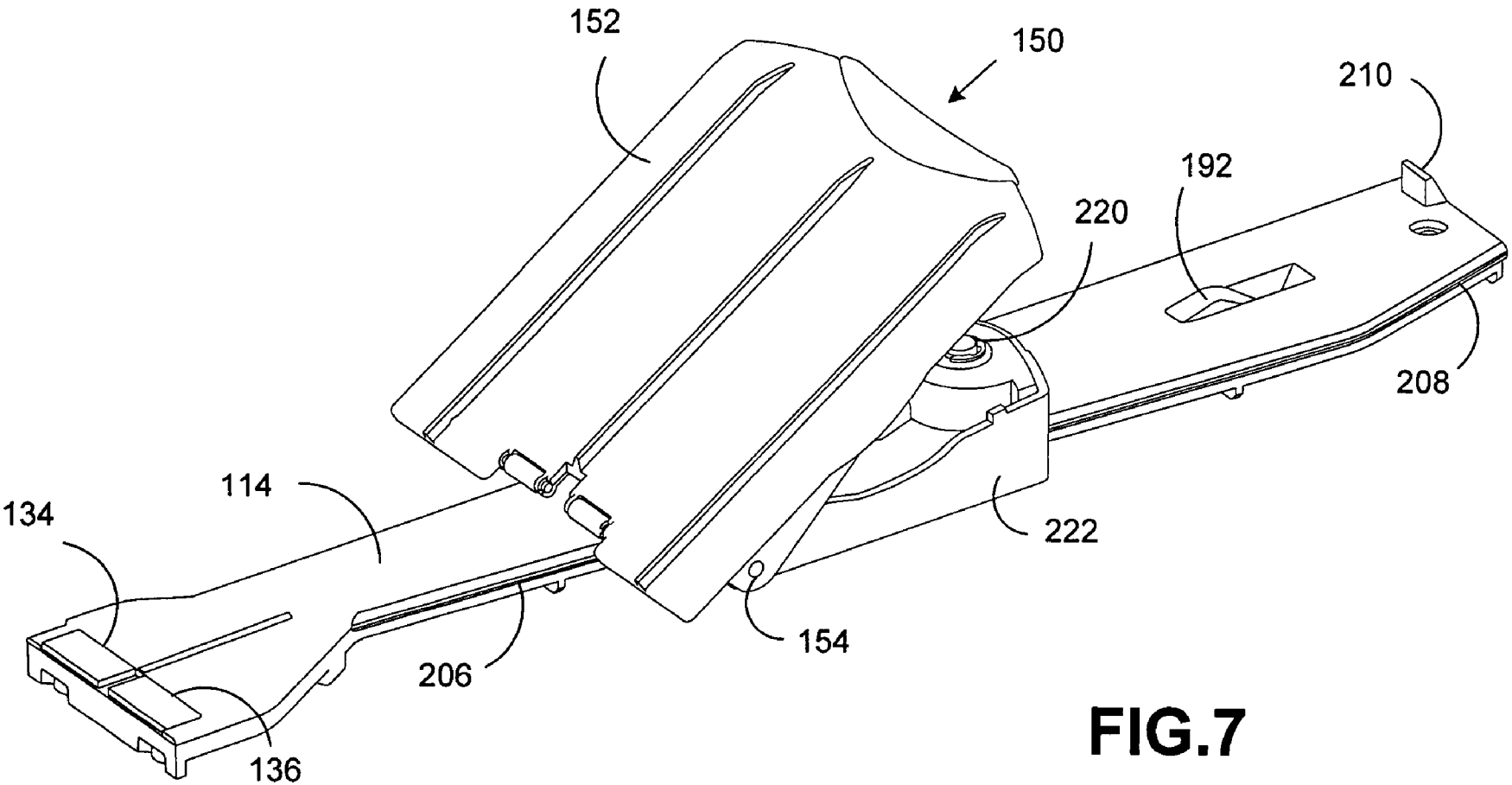
FIG. 7 is a perspective view of a portion of the shingle feed tray shown in FIG. 1 illustrating the tray tapered rail and sled mechanism.
Figure 8:
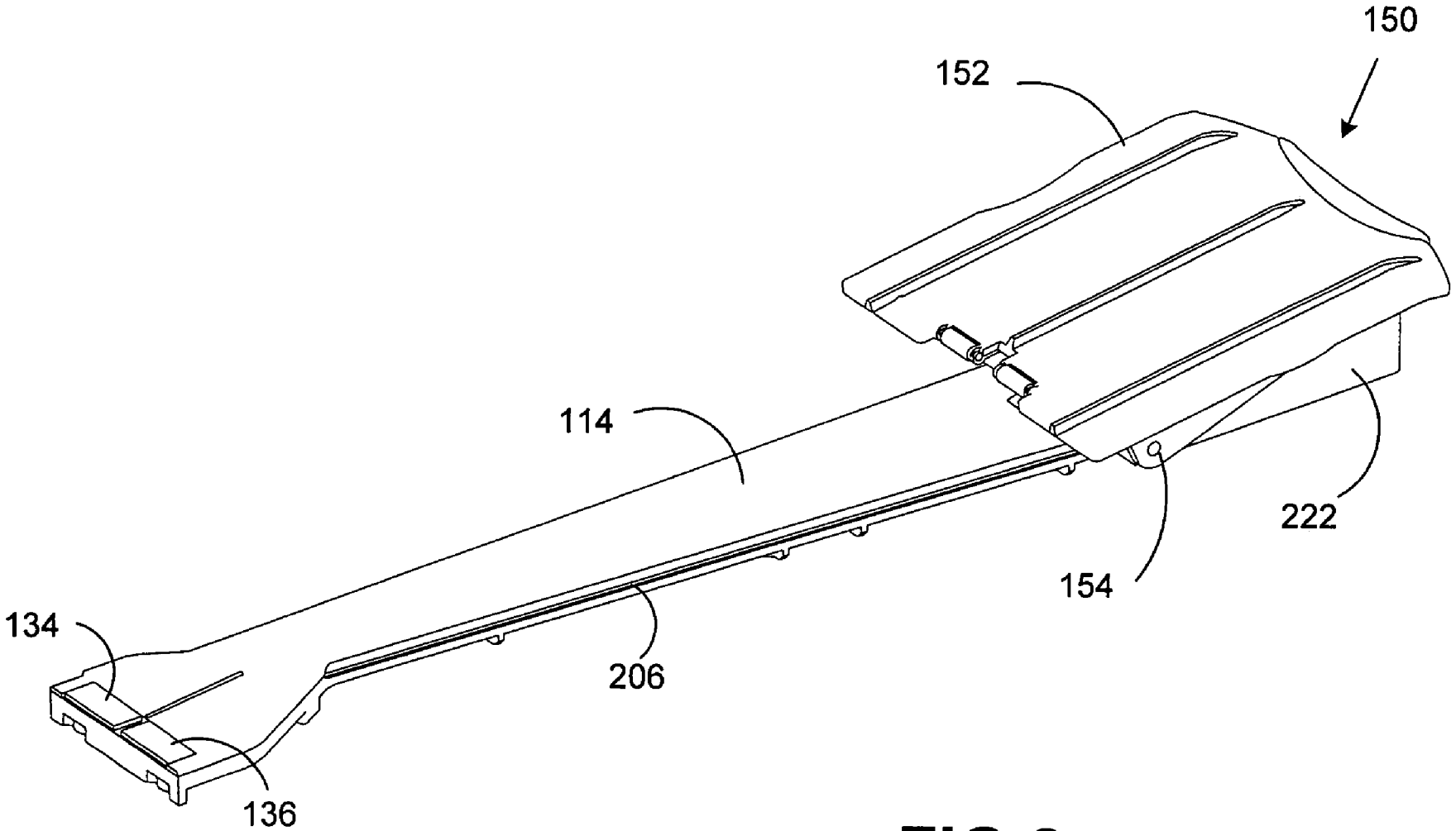
FIG. 8 is a perspective view of the shingle feed tray tapered rail and sled mechanism shown in FIG. 7 with the sled handle positioned to facilitate the loading of media items.
Figure 9:
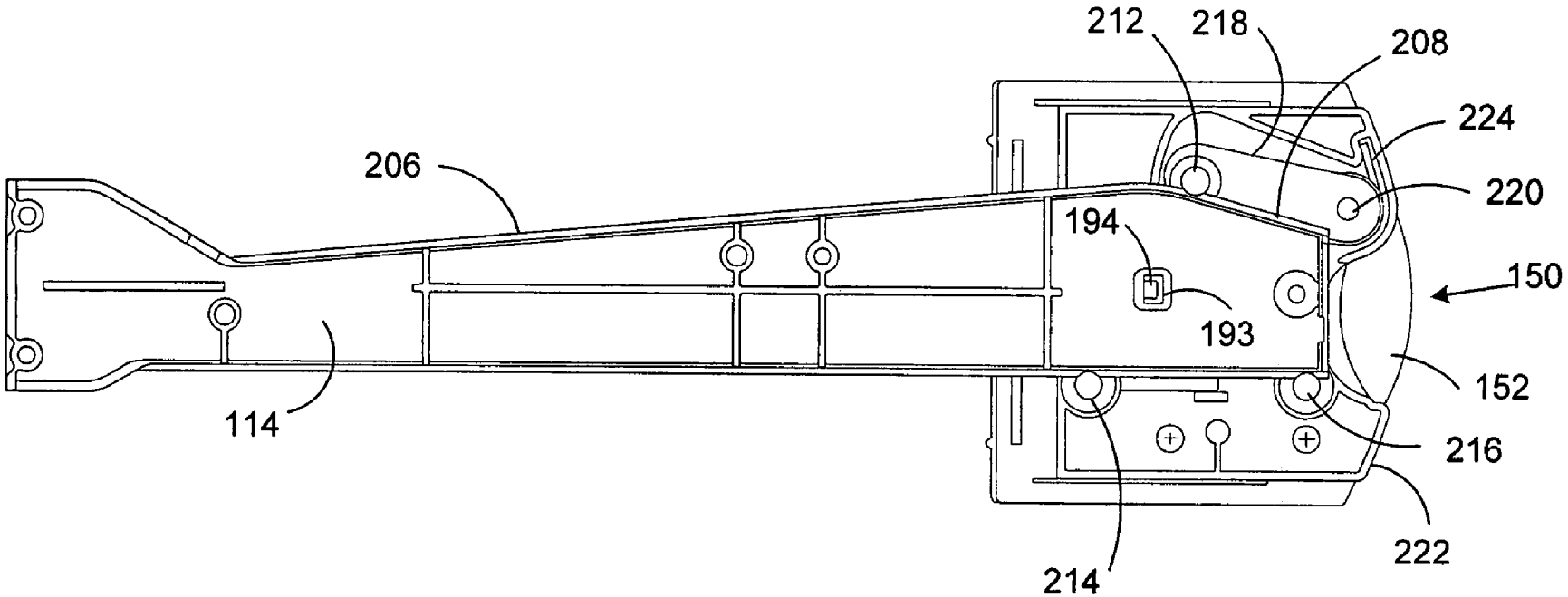
FIG. 9 is a bottom view of the shingle feed tray tapered rail and sled shown in FIG. 8.

As is shown in FIGS. 7, 8 and 9, the sled 150 is mounted to the tapered sled rail 114, which includes a first tapered section 206 and a second tapered section 208. Other shaped sections rather than tapered sections may be employed depending on how it is desired for the sled to be urged to move. This would be based on the particular design of the feed tray. The sled 150 will be urged to move toward the front end of the rail and the exit area of the tray 102 when positioned on section 206. The second tapered section 208 is located at the rear of the tapered sled rail 114. Tapered rail section 206 cooperates with the spring member 224 and related structure mounted on the sled 150 to urge the sled to move toward the front exit area of the shingle tray feed tray 102 when the sled is positioned on section 206. This urges the shingled media items in the tray toward the feed head assembly 160. The tapered rail section 208 cooperates with the spring member 224 and related structure mounted on the sled 150 to urge the sled to move away from the exit area of the tray 102 and away from the front end of the rail when the sled is positioned on section 208. The sled 150 is locked from movement when the sled handle 152 (front face) is folded or rotated toward the bottom surface of the tray 102.

The tapered sled rail 114 includes a cover engaging member, an end-stop 210, which cooperates with a spring-loaded moveable cover 334 (shown in FIG. 11) on the sled 150. Movement of the spring-loaded moveable cover 334 when engaged with end stop 210 exposes an opening in the tapered rail 114. This enables a member, the cam follower locking projection 194 (shown in FIG. 5), to project through the sled opening and the tray bottom surface opening. The sled 150 is urged in the direction of the end-stop 210 by the reverse taper of rail section 208, in conjunction with the sled spring 324 and its associated mechanism. In the position shown in FIG. 8, the sled handle 152 (front face) has been rotated in the clockwise direction and is positioned to be adjacent the bottom surface 112 of the shingle feed tray 102. The cam 192 is provided to ensure that as the sled 150 moves forward toward the front of the shingle feed tray 102, the cam follower locking projection 194 (shown in FIG. 5) causes the sled handle 152 (front face) to rotate in the counterclockwise direction to be positioned to properly support shingled media items loaded into the tray. In this position, the sled 150 is enabled for movement toward the tray exit area. The counterclockwise rotation of the sled handle 152 (front face) is from the position of the sled handle shown in FIG. 8 to the position of the sled handle 152 shown in FIG. 7.

As is shown in FIG. 9, the sled 150 is retained on the tapered sled rail 114 by three capstans 212, 214 and 216. Thus the sled 150 is constrained to ride on the tapered rail 114 by capstans 212, 214 and 216 which contact at the top and bottom of the rail, preventing the sled from moving out of the plane of the tray. Capstan 212 is supported in an arm 218. The arm 218 is mounted for rotation to a pivot 220 on sled frame 222. Depending upon the particular position of the sled along the tapered rail 214, the arm 218 is biased toward the tapered rail sections 206 or 208 by a spring 224. There, the tapered rail sections 206 and 208 provide two cam surfaces for capstan 212, which is a cam follower constrained by the cam surfaces. The force of the spring 224 against the arm 218, and thus the capstan 212, causes the capstan 212, which engages the tapered rail 114, to urge the sled 150 in the direction determined by the taper of the rail 114. Since the moveable sled 150 is positioned on the tapered section 206, as shown in FIG. 9, the force of the spring 224 via the arm 218 and capstan 212 urges the sled 150 to move in a direction toward the exit area 108 of tray 102. When the sled 150 is positioned on the tapered sled rail section 208, the sled 150 is urged to move toward the end stop 210 shown in FIG. 7.

Figure 10:
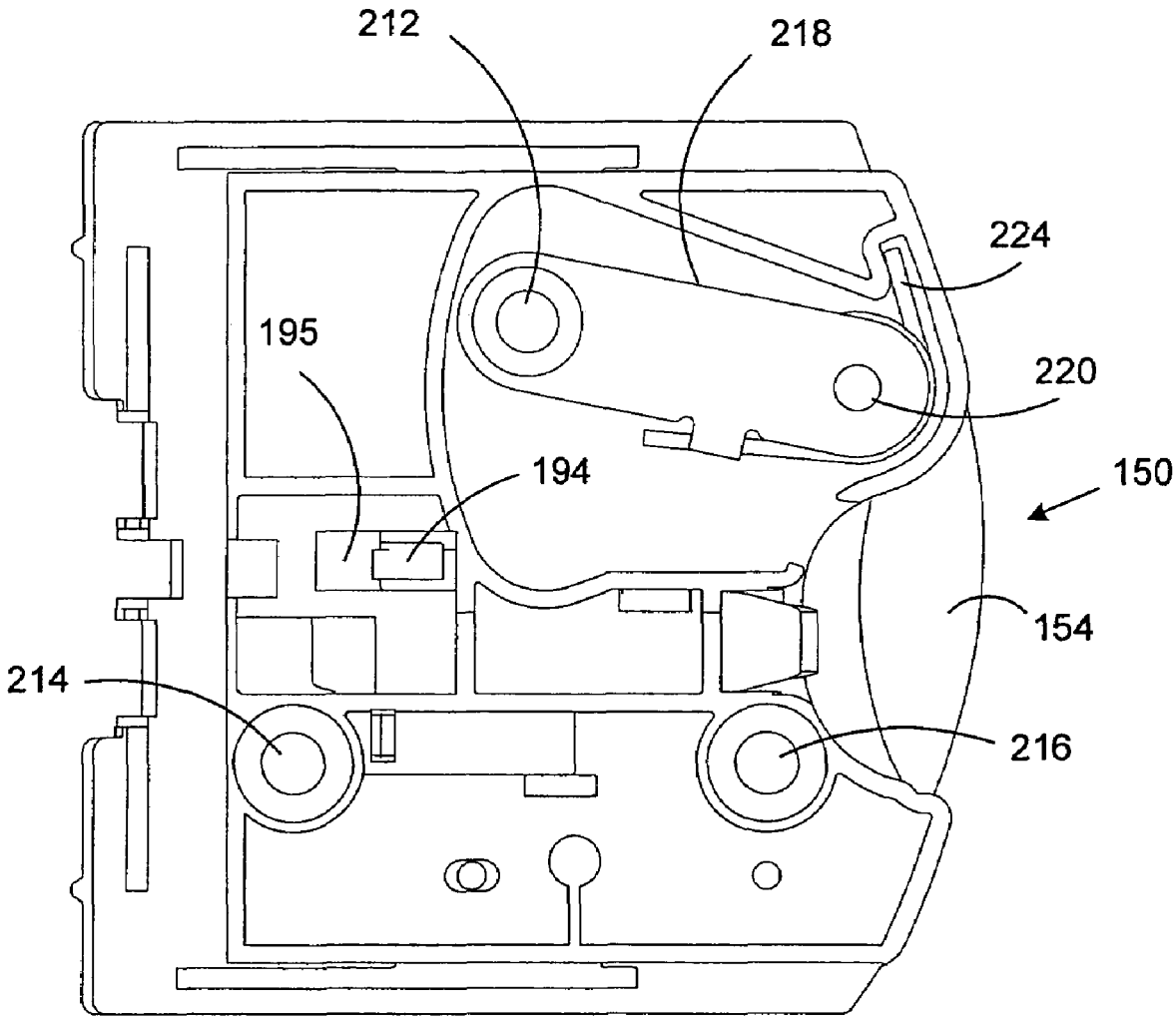
FIG. 10 is a bottom view of the shingle feed tray sled mechanism shown in FIGS. 7 and 8.
Figure 11:
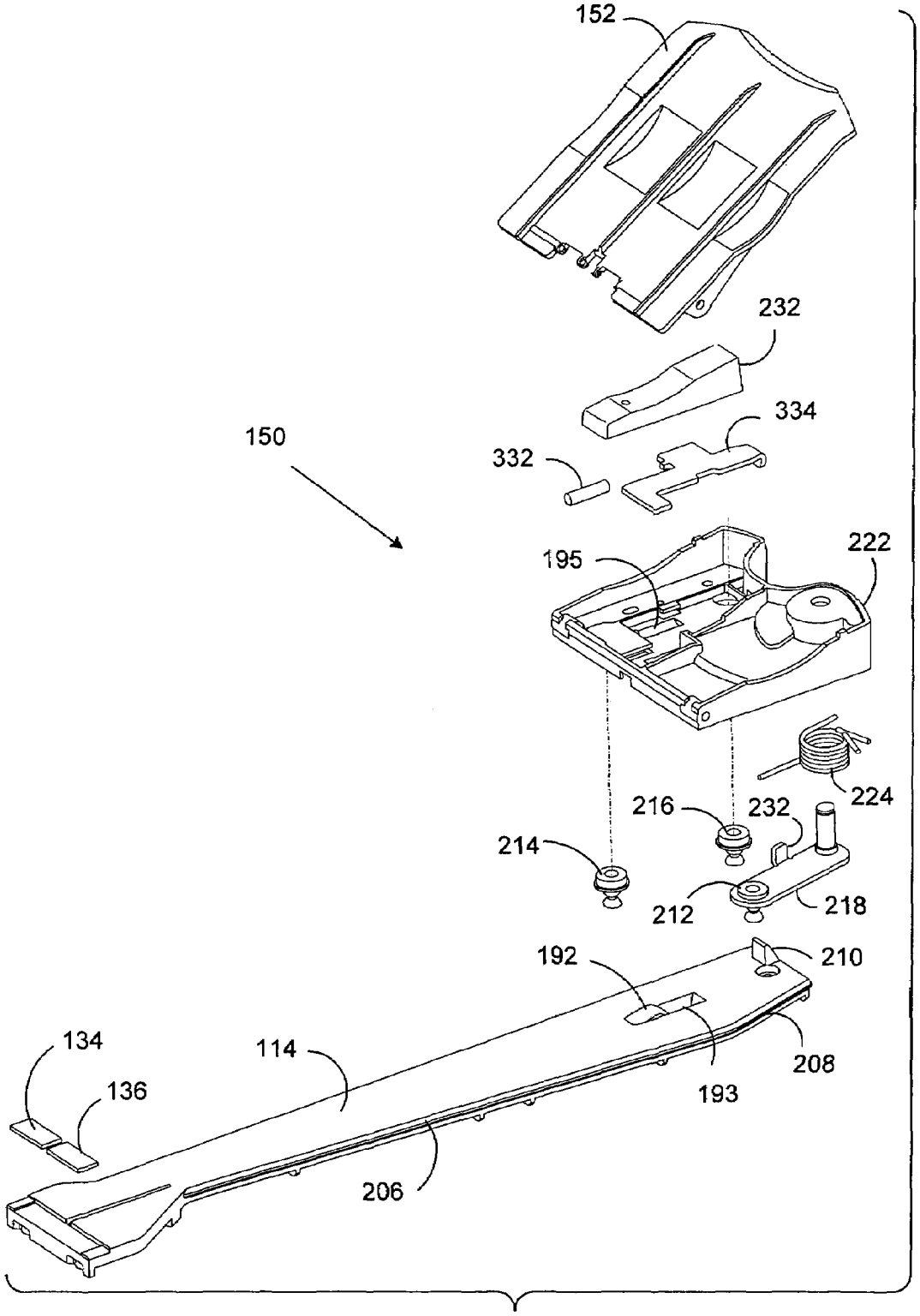
FIG. 11 is an exploded view of portions of the shingle feed tray sled mechanism shown in FIGS. 9 and 10.

The spring 224 has an end portion 230 which is connected to a tab 232 on arm 218, as is shown in FIG. 10. To adjust the weight of the sled 150, a weight 232, as is shown in FIG. 11, is connected to the sled frame 222. The weight 232 for the configuration of the tray shown in the figures is approximately 80 grams. The weight is constrained to fit within the sled base 222 and allow sled handle 152 to pivot clockwise fully to cover the sled base 222 and improve the ease of loading of the shingle tray 102. The weight 232 augments the force of spring 222 to move the sled when the shingle feed tray 102 is mounted to the feed head assembly 160 and is sloped or angled at approximately 15 degrees from the horizontal. Thus, the force on the sled 150 to help move shingled media items toward the feeder is due to the combination of the force of spring 224 and the force exerted by the weight 232. However, the incorporation of the spring 224 and related mechanism in cooperation with the tapered rail reduces the mass required of the sled to impart the energy needed for shingle media advancement down the shingle tray 102. Reduction of the mass reduces the slide hammer effect, where the sled would race from one end of the tray 102 to the other and stop abruptly causing significant impact energy transfer due to the high mass of the sled.

The sled frame 222 includes an opening 195 and a corresponding opening 193 in the tapered sled rail 114 through which the sled handle cam follower locking projection 194 can be moved. The sled frame opening 195 is covered by the spring-loaded moveable cover 334 except when the sled 150 is positioned where the moveable cover 334 engages the end stop 210. The cover 334 is biased by a spring 336 in a direction to cover the sled frame opening 195. As member 334 engages the end-stop 210, the cover 334 is caused to slide against the force of the spring 336. This uncovers the sled frame opening 195 and allows the sled handle 152 (front face) into the folded position. In this position of the sled 150 on the tapered rail 114, the sled frame opening 195 and the tapered rail opening are aligned. In all other positions of the sled 150 on the tapered sled rail 114, the cover 334 covers the sled frame opening 195 and blocks the sled handle 152 (front face) from being rotated in the clockwise direction, which could cause friction if it engaged the top surface of the tapered rail 114.

The term media item is intended herein to be a broad term and to include mail pieces such as various types of mail pieces such as letter mail, envelopes and postcards. Other examples of media items include sheets of paper, checks, envelopes, slips booklets, packages of greeting cards, and any other items that can be fed from a shingle type feed tray. Accordingly, while the detailed description and figures with media items are directed to the processing of envelopes, any other suitable media items can be substituted for such media items in the description. Additionally, different types and arrangements of shaped rails, cam surface, cam followers, moveable sled and springs may be employed, as well as other types of mechanisms and components where similar functionality is provided. For example, the rails may be non-tapered and the spring may be a long extension spring, eliminating weights. Moreover, a curved shaped rail may be employed and configured to compensate for follower spring behavior and for drag. As another example, the spring stop position could be adjustable by an operator to adjust sled forces and compensate for tolerances and types and amount of media in the stack.

While the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended claims.

What is claimed is:

1. A media item feed tray having an exit area for media items, comprising:

a rail having a first tapered section and a second tapered section;

a sled mounted on said rail for movement toward and away from said exit area, said rail including a cam follower; and, a spring member mounted on said sled and operatively connected to said cam follower such that when said cam follower engages said first tapered section said sled is urged toward the exit area and when said cam follower engages said second tapered section said sled is urged away from the exit area.

2. A media item feed tray as defined in claim 1 wherein said sled includes a locking mechanism for locking said sled from movement toward and away from the exit area.

3. A media item feed tray as defined in claim 2 wherein said locking mechanism includes a sled front face, said sled front face moveable into a first position to lock sled from movement and said sled front face moveable into a second position where said sled is moveable toward and away from the exit area.

4. A media item feed tray as defined in claim 3 wherein said rail includes a face having an opening and said sled front face is connected to a member which projects through said rail face opening when said sled front face is in said first position to lock said sled from movement and said member is retracted from said rail face opening when said sled front face is in said second position where said sled is moveable toward and away from said feed tray exit area.

5. A media item feed tray as defined in claim 4 wherein said sled includes a surface with an opening and wherein said member projects through said sled surface opening and through said rail face opening when said sled is positioned such that said sled surface opening and said rail face opening are aligned and said sled front face is in said first position to lock said sled and said member is retracted from said rail face opening and from said sled surface opening when said sled front face is in said second position where said sled is moveable toward and away from the exit area.

6. A media item feed tray as defined in claim 5 further including a cover moveably mounted to said sled, said cover biased to cover said sled surface opening, said cover moveable to uncover said sled surface opening when said sled is moved to a position where said sled surface opening and said rail face opening are aligned.

7. A media item feed tray as defined in claim 6 including a cover engaging member, said cover engaging member engaging said cover to move said cover to uncover said sled surface opening when said sled is positioned such that said sled surface opening and said rail face opening are aligned.

8. A media feed tray as defined in claim 1, wherein the first tapered section is tapered toward the exit area and the second tapered section is tapered away from the exit area.

* * * * *